US007972160B2

(12) United States Patent
Jeong et al.

(10) Patent No.: US 7,972,160 B2
(45) Date of Patent: Jul. 5, 2011

(54) ADAPTER FOR ELECTRICAL DEVICE

(75) Inventors: Yong-joon Jeong, Seongnam-si (KR); Jong-sub Lee, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 127 days.

(21) Appl. No.: 12/284,058

(22) Filed: Sep. 18, 2008

(65) Prior Publication Data

US 2009/0081898 A1 Mar. 26, 2009

(30) Foreign Application Priority Data

Sep. 21, 2007 (KR) ..... 10-2007-0096935

(51) Int. Cl.
*H01R 13/62* (2006.01)

(52) U.S. Cl. ..... 439/304; 439/638

(58) Field of Classification Search ..... 439/304, 439/521, 638
See application file for complete search history.

(56) References Cited

U.S. PATENT DOCUMENTS 5,577,923 A * 11/1996 Lee ..... 439/170
6,692,298 B2 * 2/2004 Oh-Yang ..... 439/542
7,488,215 B2 * 2/2009 Mayette et al. ..... 439/638
7,623,182 B2 * 11/2009 Byrne et al. ..... 348/375
2002/0162366 A1 * 11/2002 Chmela et al. ..... 70/58
2003/0117499 A1 * 6/2003 Bianchi et al. ..... 348/211.2
2004/0257464 A1 * 12/2004 Pandit et al. ..... 348/373

FOREIGN PATENT DOCUMENTS

JP 2000-131324 A 5/2000
JP 2001-215585 A 10/2001
JP 2002-165679 A 6/2002

* cited by examiner

*Primary Examiner* — T C Patel
*Assistant Examiner* — Travis Chambers
(74) *Attorney, Agent, or Firm* — Drinker Biddle & Reath LLP

(57) ABSTRACT

Provided is an adapter for an electrical device such as a photographing device. In an embodiment, the adapter includes a base frame, a connector that is disposed in the base frame and can be connected to a power input terminal of the electrical device, and a power input jack that is disposed in the base frame and electrically connected to the connector and can be connected to an external power supply device. In yet another embodiment, the power input jack of the previously-mentioned embodiment is replaced with a power input cord having a plug that is configured to interface with an external power supply device such as an AC power outlet.

12 Claims, 7 Drawing Sheets

ADAPTER FOR ELECTRICAL DEVICE

CROSS-REFERENCE TO RELATED PATENT APPLICATIONS

This application claims the benefit of Korean Patent Application No. 10-2007-0096935, filed on Sep. 21, 2007, in the Korean Intellectual Property Office, the disclosure of which is incorporated herein in its entirety by reference.

BACKGROUND OF THE INVENTION

1. Field of the Invention

The present invention relates to an adapter for an electrical device, and more particularly, to an adapter for an electrical device which can stably supply external power to the electrical device and has improved durability.

2. Description of the Related Art

In general, electrical devices are products using batteries. Such electrical devices are usually displayed in street sales booths for sale. Continued use of displayed electrical devices can be inconvenient for the person working at the booth or display since a battery must be changed when the battery is discharged due to repetitive use/testing.

In order to solve this problem, a power input terminal of the electrical device can be connected to an external power supply device to continuously charge the battery of the electrical device or otherwise bypass the battery. For example, a power input terminal is included in an electrical device so that the device can be connected to an external power supply device, such as a plug, so that DC power can be supplied to the electrical device. However, in this case, if the electrical device is repeatedly tested or otherwise used while being displayed in a sales booth, the power input terminal of the electrical device may be frequently separated from the external power supply device. Thus the power input terminal and the external power supply device are repeatedly connected to and separated from each other, thus causing damage or excessive wear and tear to the power input terminal. In particular, if such a damaged electrical device is left in the case of an unguarded sales booth, the product image and sales performance thereof are degraded.

In one conventional solution to this problem, a battery is removed from a battery insertion part of an electrical device and a fake battery is inserted to replace the removed battery. The fake battery includes a flexible printed circuit board that is exposed outside the electrical device when the fake battery is installed in the device so that a free end of the flexible printed circuit board can be connected to an external power source device. However, in this case, the flexible printed circuit board is likely to be snapped or otherwise broken or damaged since the electrical device is displayed on a sales booth and repeatedly used.

SUMMARY OF THE INVENTION

The present invention provides an adapter for an electrical device, the adapter having good durability and being operable to stably supply external power to the electrical device.

According to an aspect of the present invention, there is provided an adapter for an electrical device, the adapter including a base frame; a connector which is disposed in the base frame and is to be connected to a power input terminal of the electrical device; and a power input jack which is disposed in the base frame and electrically connected to the connector, and which is to be connected to an external power supply.

According to another aspect of the present invention, there is provided an adapter for an electrical device, the adapter including a base frame; a connector which is disposed in the base frame and is to be connected to a power input terminal of an electrical device; and a cord that is connected to the base frame and electrically connected to the connector, and having a plug at one end of the cord.

The adapter may further include a coupling unit for releasably connecting the base frame to the electrical device.

The electrical device may be a photographing device, and the adapter may be configured to attach to the photographing device. In one example, the coupling unit of the adapter may be coupled to a tripod coupling unit of the photographing device.

The coupling unit may additionally include an anti-theft interface for facilitating coupling of the base frame to the electrical device and also facilitating coupling of the base frame and electrical device to an anti-theft unit for protecting the electrical device.

A location of the coupling unit may be adjustable according to the location of a coupling unit of the electrical device.

The adapter may further include a guiding unit for adjusting a location of the coupling unit along a dimension of the adapter so that the coupling unit can be moved to correspond with a tripod coupling unit or other feature of the electrical device.

The adapter may further include an anti-theft unit coupling unit to which an anti-theft unit, which protects the electrical device against theft, is to be coupled.

The location of the connector may be adjustable within the base frame according to the location of the power input terminal of the electrical device.

The base frame may include an inner space, recess or cavity in which the connector is to be placed, and the connector may be placed in the inner space of the base frame but is not necessarily fixed in or otherwise unitary with the base frame.

The adapter may further include a wire electrically connecting the power input jack to the connector. The base frame may include an inner space, recess or cavity in which the connector is to be placed. The connector may be placed in the inner space of the base frame but is not necessarily fixed in the base frame, and the wire is flexible thus allowing the connector to be placed inside the base frame or to be exposed from the base frame.

The power input jack may be fixed in the base frame.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Exemplary embodiments of the present invention will now be described in detail with reference to the accompanying drawings.

Figure 1:
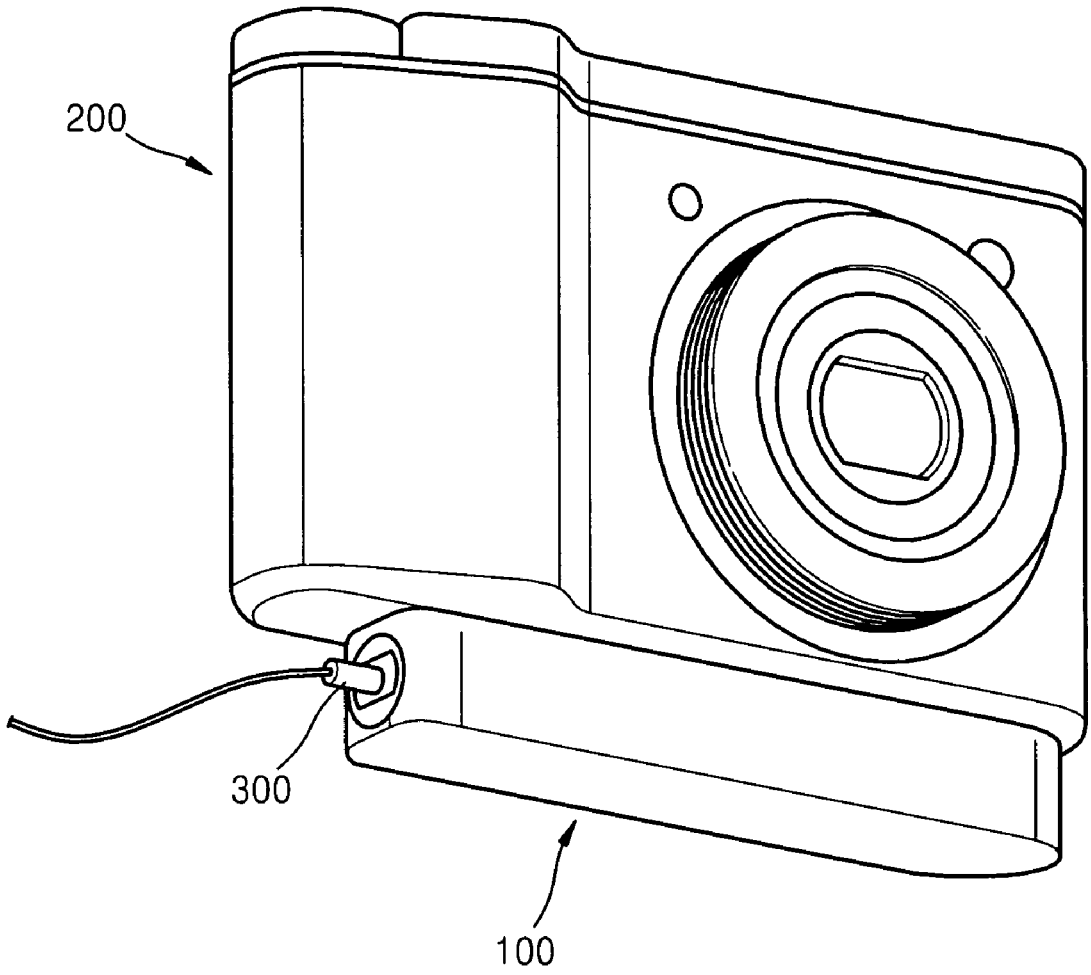
FIG. 1 is a perspective view illustrating an adapter for an electrical device, which is coupled to an electrical device, according to an embodiment of the present invention.
Figure 2:
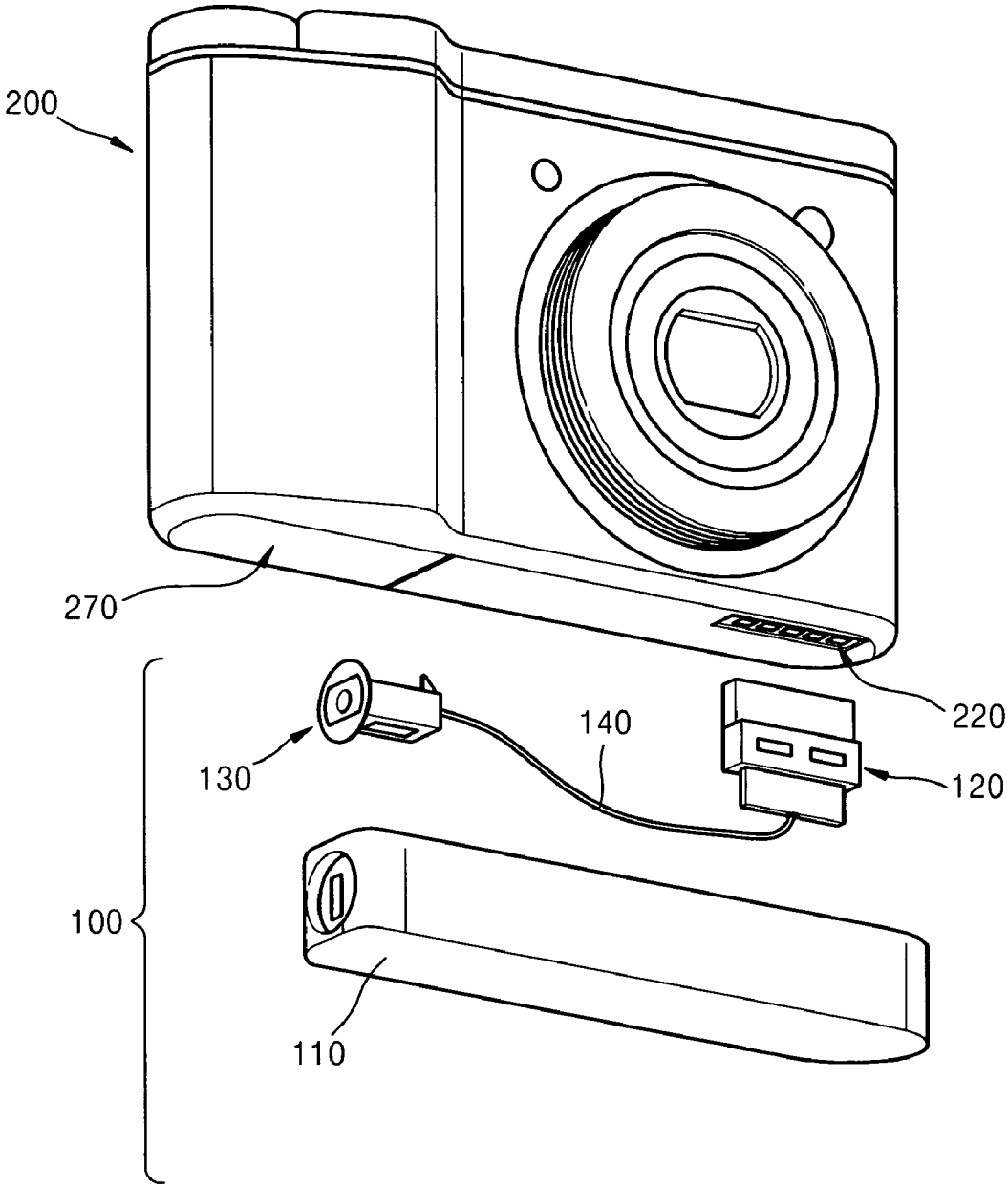
FIG. 2 is an exploded perspective view illustrating the relationship between the adapter for an electrical device and the electrical device illustrated in FIG. 1.

FIG. 1 is a schematic perspective view illustrating an adapter 100 for an electrical device, which is coupled to an electrical device 200 according to an embodiment of the present invention. FIG. 2 is an exploded perspective view illustrating the relationship between the adapter 100 for an electrical device and the electrical device 200 illustrated in FIG. 1.

Referring to FIG. 1, the adapter 100 may be coupled to an electrical device 200. FIG. 1 illustrates a camera as the electrical device 200, but the electrical device 200 may be various electrical devices known in the art. Accordingly, the adapter 100 may be configured or adapted relative to a form factor or configuration of the device 200. Although the adapter 100 can be configured for various types of electrical devices, such as a personal multimedia player (PMP) or a personal digital assistant (PDA), hereinafter, for convenience of explanation, the present invention will be described with respect to a case where the electrical device 200 is a camera.

The adapter 100 can be connected to an external power supply device 300, such as a plug of a power cord as shown. Since the adapter 100 interfaces between the external power supply device 300 and the electrical device 200, the adapter 100 is configured to supply power from the external power supply device 300 to the electrical device 200.

Referring to FIG. 2, the adapter 100 includes a housing or base frame 110, a connector 120, and a power input jack 130. The connector 120 is disposed in the base frame 110, and can be connected to a charging or power input terminal 220 of the electrical device 200. As shown in FIG. 2, the connector 120 of the adapter 100 is shaped, configured, etc. to have a complementary configuration to the power input terminal 220 of the electrical device 200. However, the power input terminal 220 and the connector 120 may have various shapes, configurations, etc. For example, the power input terminal 220 may include 24 pins for connecting to or otherwise mating or interfacing with a complementary 24-pin connector, such as a power input terminal of a mobile phone.

The power input jack 130 is also disposed in the base frame 110, and is electrically connected to the connector 120. The power input jack 130 is configured to be connected to an external power supply device 300 (FIG. 1). Although FIG. 2 illustrates that the power input jack 130 is electrically connected to the connector 120 via a wire 140, the present invention is not limited thereto. That is, the power input jack 130 and the connector 120 may be electrically connected by various conductive elements known in the art such as, a busbar, a metallic trace on a circuit board, a fuse, etc.

As described previously, conventionally, the power input terminal 220 of the electrical device 200 is connected to an external power supply device, such as a plug, in order to supply DC power to the electrical device 200. However, in contrast, the present adapter 100 includes the connector 120 via which the adapter 100 can be connected to the power input terminal 220 of the electrical device 200. If the connector 120 and the base frame 110 are connected, integrally or unitarily formed, the adapter 100 may be firmly connected to the electrical device 200 via the connector 120 mating or otherwise interfacing with the power input terminal 220 of the electrical device 200. Thus, when the electrical device 200 is coupled to the adapter 100 and displayed in a sales booth (wherein the device 200 is repeatedly demonstrated), the adapter 100 reduces wear and tear on the device 200, particularly the power input terminal 220. Also, the durability of the adapter 100 is improved over conventional adapters or fake batteries since the adapter 100 does not have a flexible printed circuit board.

The power input jack 130 of the adapter 100 may have a shape different from that of the power input terminal 220 of the electrical device 200. Unlike the power input terminal 220, the power input jack 130 can have a durable shape in order to not be damaged even if the adapter 100 is repeatedly coupled to and separated from an external power supply device. That is, the power input jack 130 of the adapter 100 may be designed to resist wear and tear resulting from repetitive connections and disconnections.

The power input terminal 220 of the electrical device 200 tends to be located at a bottom surface of the electrical device 200 in terms of the design and aesthetics of the electrical device 200 as illustrated in FIG. 2. In this case, if an external power supply device is connected to the power input terminal 220 at the bottom surface of the electrical device 200, it is very difficult to stand the electrical device 200 upright on a surface of a sales booth with the bottom surface of the electrical device 200 contacting the surface of the sales booth. However, the power input jack 130 of the present adapter 100 is exposed via a side surface of the adapter 100 and thus the electrical device 200 can be disposed such that the can stand upright on the surface of a sales booth even if the power input jack 130 is connected to an external power supply device.

As described above, the adapter 100 not only prevents the power input terminal 220 of the electrical device 200 from being damaged when the electrical device 200 is displayed in a sales booth but also makes it possible to variously change the location of the electrical device 200 in the sales booth for display.

Figure 3:
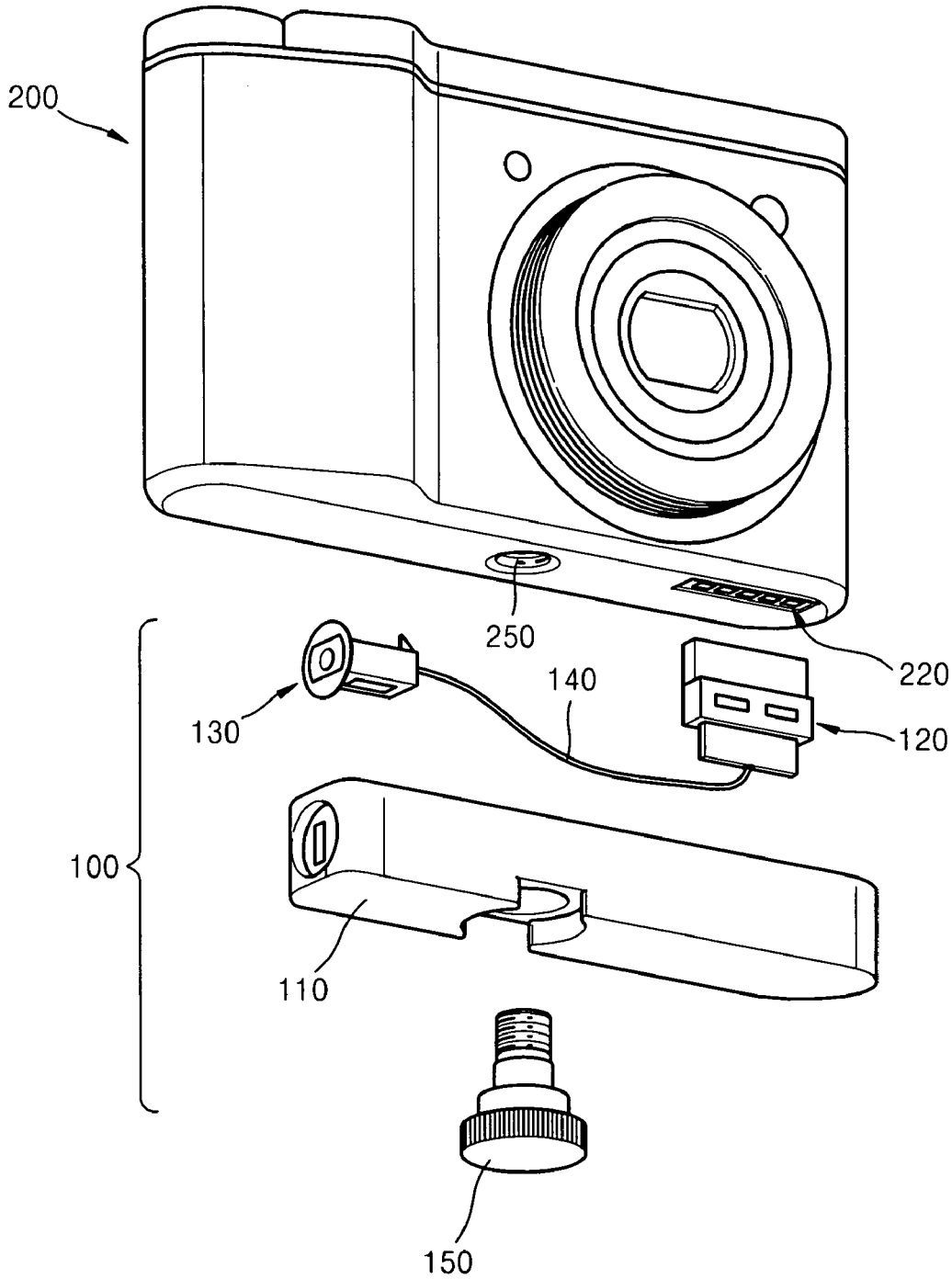
FIG. 3 is an exploded perspective view illustrating an adapter for an electrical device according to another embodiment of the present invention.

FIG. 3 is an exploded perspective view illustrating the relationship between an electrical device 200 and another embodiment of an adapter 100 for an electrical device. Referring to FIG. 3, the adapter 100 may be combined with the electrical device 200. FIG. 3 illustrates a camera as the electrical device 200 but the type of electrical device 200 may be various electrical devices known in the art. The adapter 100 according to the current embodiment can configured for various types of electrical devices, such as a PMP or a PDA.

The adapter 100 includes a base frame 110, a connector 120, a power input jack 130, and a coupling unit 150. The connector 120 is disposed in the base frame 110 and can be connected to a power input terminal 220 of the electrical device 200. In the current embodiment, the connector 120 of the adapter 100 is shaped, configured, etc. to be connected to the power input terminal 220 of the electrical device 200, as illustrated in FIG. 3. The power input jack 130 is disposed in the base frame 110, and is electrically connected to the connector 120. The power input jack 130 is configured to be connected to an external power supply device. Although FIG. 3 illustrates that the power input jack 130 is electrically connected to the connector 120 via a wire 140, the present invention is not limited thereto as was described previously with respect to the embodiment shown in FIGS. 1 and 2. The coupling unit 150 allows the base frame 110 to be releasably connected to the electrical device 200. As shown, the base frame 110 may include an opening, aperture, groove or the like that is configured to accept the coupling unit 150 so that the base frame 110 can be coupled with the device 200.

In the current embodiment, the adapter 100 includes the connector 120 that can be connected to the power input terminal 220 of the electrical device 200. The connector 120 and the power input terminal 220 can be firmly connected to each other when the adapter 100 is connected with the electrical device 200. Thus the adapter 100 according to the current embodiment prevents the power input terminal 220 of the electrical device 200 from being damaged. Also, in this embodiment of the adapter 100, the connector 120 need not be connected to, integral or unitary with the base frame 110 since the coupling unit 150 is provided to connect the adapter 100 with the device 200.

As shown in FIG. 3 the electrical device 200 may be a photographing device that includes a standard tripod coupling unit 250 at a bottom surface thereof. As known in the art, the tripod coupling unit 250 is a hole, aperture, recess or the like with internal threads. The photographing device 200 may be mounted to a tripod (not shown) by inserting a threaded fastener of the tripod into the tripod coupling unit 250. Thus the coupling unit 150 of the adapter 100 may be a threaded fastener or the like that is configured to be mated or otherwise interfaced with the tripod coupling unit 250. Using the coupling unit 150, the present adapter 100 can be connected with various types of photographing devices without being modified.

Figure 4:
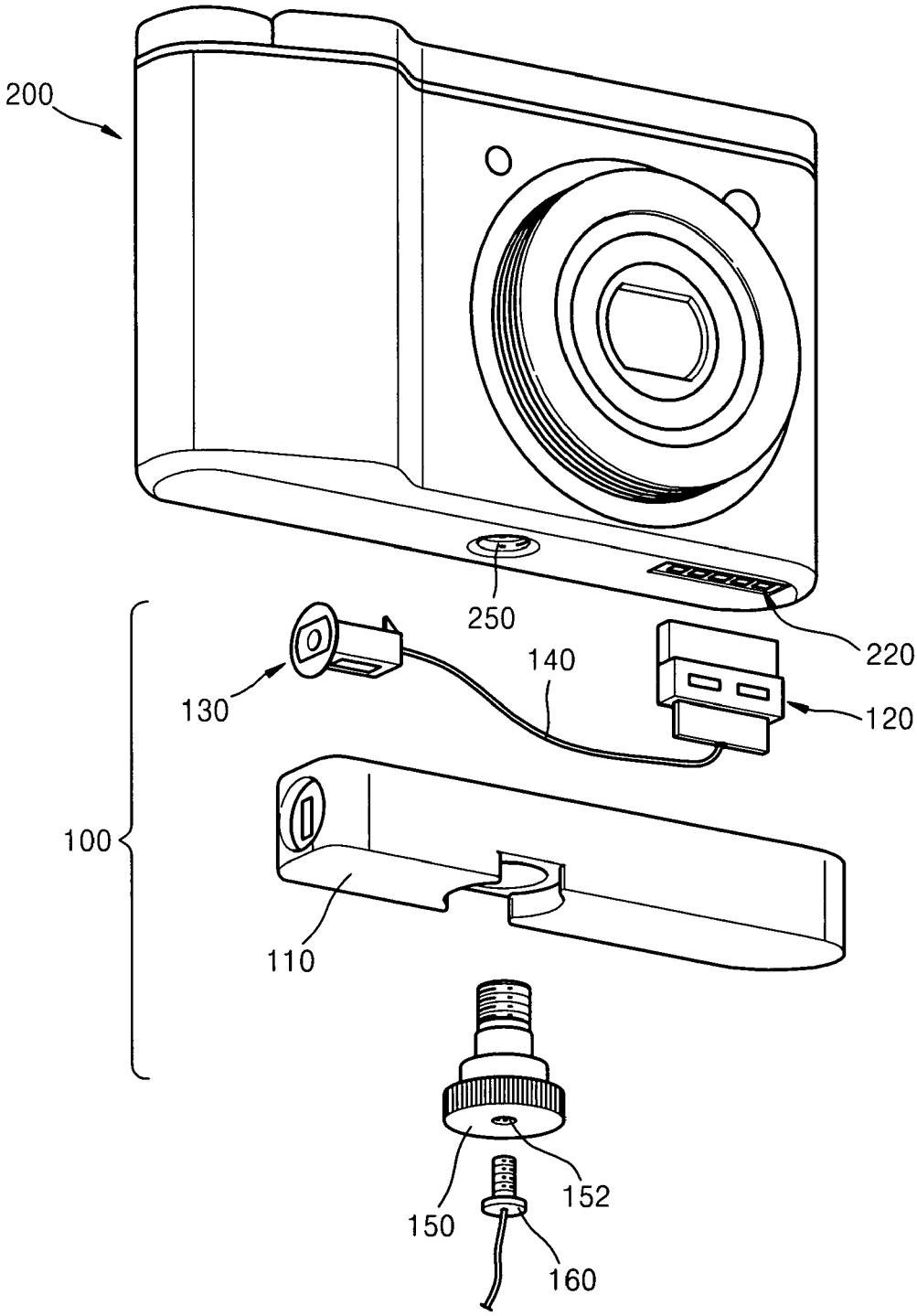
FIG. 4 is an exploded perspective view illustrating an adapter for an electrical device according to another embodiment of the present invention.

FIG. 4 is an exploded perspective view illustrating the relationship between an electrical device 200 and yet another embodiment of an adapter 100 for an electrical device.

The adapter 100 according to the illustrated embodiment of FIG. 4 is different from the adapter 100 illustrated in FIG. 3 in that the coupling unit 150 can not only allow the electrical device 200 to be coupled with the base frame 110 but can also allow the electrical device 200 to be combined with an anti-theft unit 160 for protecting the device 200 against theft. When the electrical device 200 is displayed in a sales booth, the electrical device 200 is generally attached to the anti-theft unit 160 (e.g., connected via a wire as shown) in order to prevent the electrical device 200 from being stolen. In a conventional situation, a part of the electrical device 200 must be changed so that it can be combined with the anti-theft unit 160. However, in the case of the adapter 100 according to the current embodiment, the coupling unit 150 of the adapter 100 is shaped to be combined with the anti-theft unit 160 and thus the electrical device 200 does not need to be modified in order to be combined with the anti-theft unit 160. Although FIG. 4 illustrates that an opening, aperture or hole 152 is formed in a bottom surface of the coupling unit 150 and the anti-theft unit 160 is inserted into the hole 152, the present invention is not limited thereto. Also, the electrical device 200 can be coupled to the coupling unit 150 in such a way that the electrical device 200 and the coupling unit 150 are not easily separated from each other such that the anti-theft unit 160 is defeated. Alternatively, the anti-theft unit 160 may be coupled to a part of the adapter 100 different than the coupling unit 150. In this case, although not shown in the drawings, the adapter 100 may further include an anti-theft unit coupling unit to which the anti-theft unit 160 can be coupled.

Figure 5:
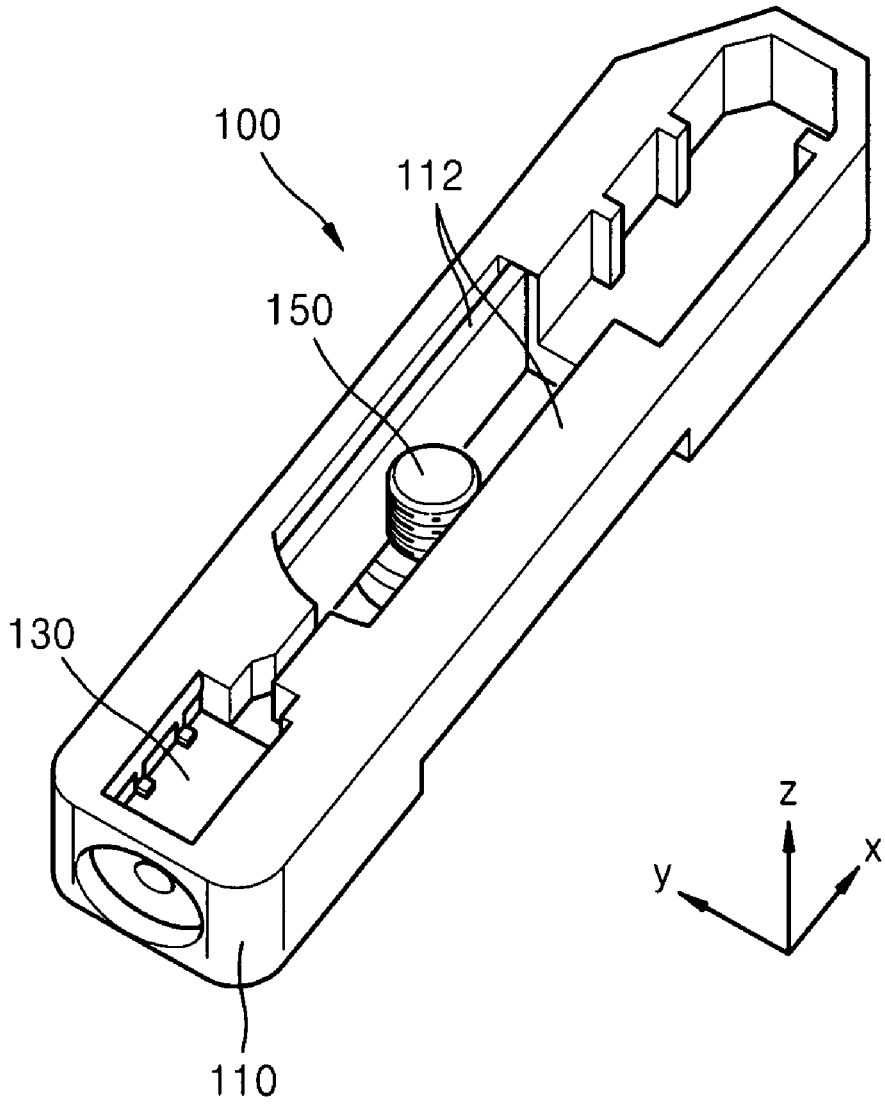
FIG. 5 is a perspective view illustrating a part of an adapter for an electrical device according to an embodiment of the present invention.

FIG. 5 is a perspective view illustrating a base frame 110 of an adapter 100 for an electrical device according to an embodiment of the present invention.

In the current base frame embodiment, the adapter 100 includes a base frame 110, a connector (not shown), a power input jack 130, and a coupling unit 150, similar to the previous embodiments of the present invention. The adapter 100, particularly the base frame 110 further includes a guiding unit 112. The guiding unit 112 guides the coupling unit 150 so that the location of the coupling unit 150 can be adjusted. FIG. 5 illustrates that the guiding unit 112 is shaped as an elongated slot, opening or aperture in order to allow the coupling unit 150 to be moved along an x-axis (i.e., a lengthwise direction of the base frame 110).

Using the guiding unit 112, the adapter 100 according to the current embodiment is adaptable to various types of electrical devices. That is, the adapter 100 may be used with various types of electrical devices. Thus the location of a part of the electrical device which is combined with the coupling unit 150 of the adapter 100 may vary according to the type of electrical device. For example, if the electrical device is a photographing device as illustrated in FIG. 3 or 4, the coupling unit 150 of the adapter 100 may be coupled to the tripod coupling unit 250 illustrated in FIG. 3 or 4, and the location of the tripod coupling unit 250 may vary according to the type of photographing device. Accordingly, the adapter 100 according to the current embodiment is designed such that the location of the coupling unit 150 can be changed according to the location of a part of the electrical device to which the coupling unit 150 is to be coupled. The guiding unit 112 illustrated in FIG. 5 is exemplary and thus may have various structures allowing the location of the coupling unit 150 of the adapter 100 to be changed or otherwise adjusted. For example, the guiding unit 112 may be a series of apertures along the x-axis and/or y-axis.

Figure 6:
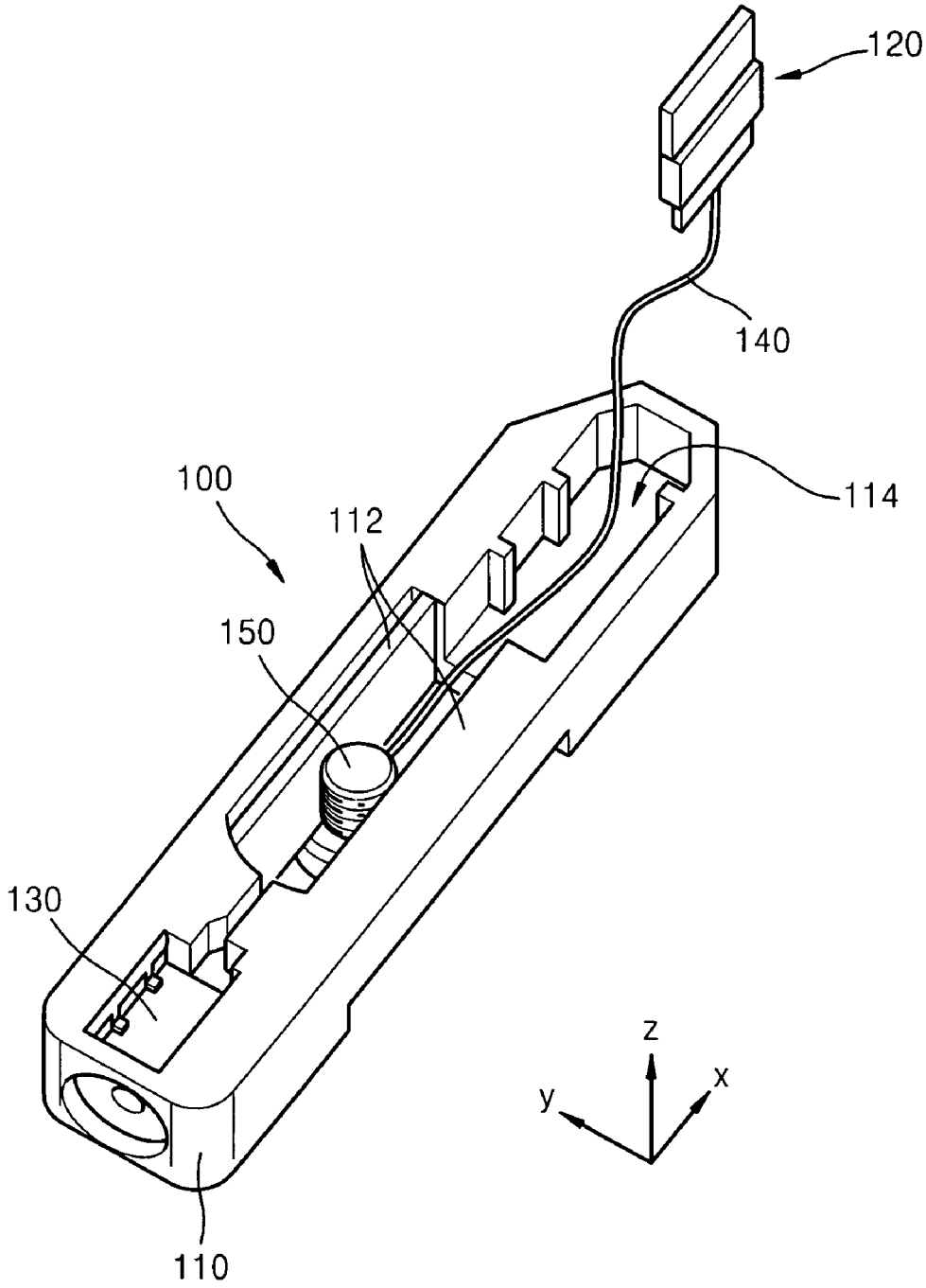
FIG. 6 is a perspective view illustrating a part of an adapter for an electrical device according to another embodiment of the present invention.

FIG. 6 is a perspective view illustrating a part of an adapter 100 for an electrical device according to still another embodiment of the present invention.

In the current embodiment, the adapter 100 includes a base frame 110, a connector 120, a power input jack 130, a coupling unit 150, and a guiding unit 112. The location of the connector 120 of the adapter 100 can be changed according to the location of a power input terminal of an electrical device, which is to be coupled to the connector 120.

As previously mentioned, the adapter 100 according to the current embodiment is not configured for only a specific type of electrical device. That is, the location of the power input terminal may vary according to the type of electrical device. Thus the adapter 100 is designed such that the location of the connector 120 may be changed according to the location of a power input terminal of an electrical device to which the connector 120 is to be coupled. Thus, the adapter 100 can be adapted to or configured for various types of electrical devices.

As illustrated in FIG. 6, the base frame 110 has an inner space 114 in which the connector 120 can be configured. The connector 120 can be placed and freely moved in the inner space 114 of the base frame 110, and thus the location of the connector 120 can be variously changed within the base frame 110 relative to the location of the device's power input terminal 220.

The adapter 100 may further include a wire 140 that electrically connects the power input jack 130 to the connector 120. The wire 140 may be flexible, thus allowing the connector 120 to be placed inside the base frame 110 at varying distances from the power input jack 130. Furthermore, the wire 140 facilitates the connector 120 to be exposed from the base frame 110. That is, the adapter 100 can be coupled to an electrical device by pulling the connector 120 out of the base frame 110, connecting the connector 120 to a power input terminal 220 (FIGS. 2-4) of the electrical device, and then orienting the base frame 110 so that the connector 120 is disposed in the inner space 114 of the base frame 110. In this way, it is possible to easily couple the connector 120 of the adapter 100 to the power input terminal of the electrical device when the adapter 100 is coupled to the electrical device. The power input jack 130 of the adapter 100 may be installed to be fixed in the base frame 110 as illustrated in FIG. 6.

Figure 7:
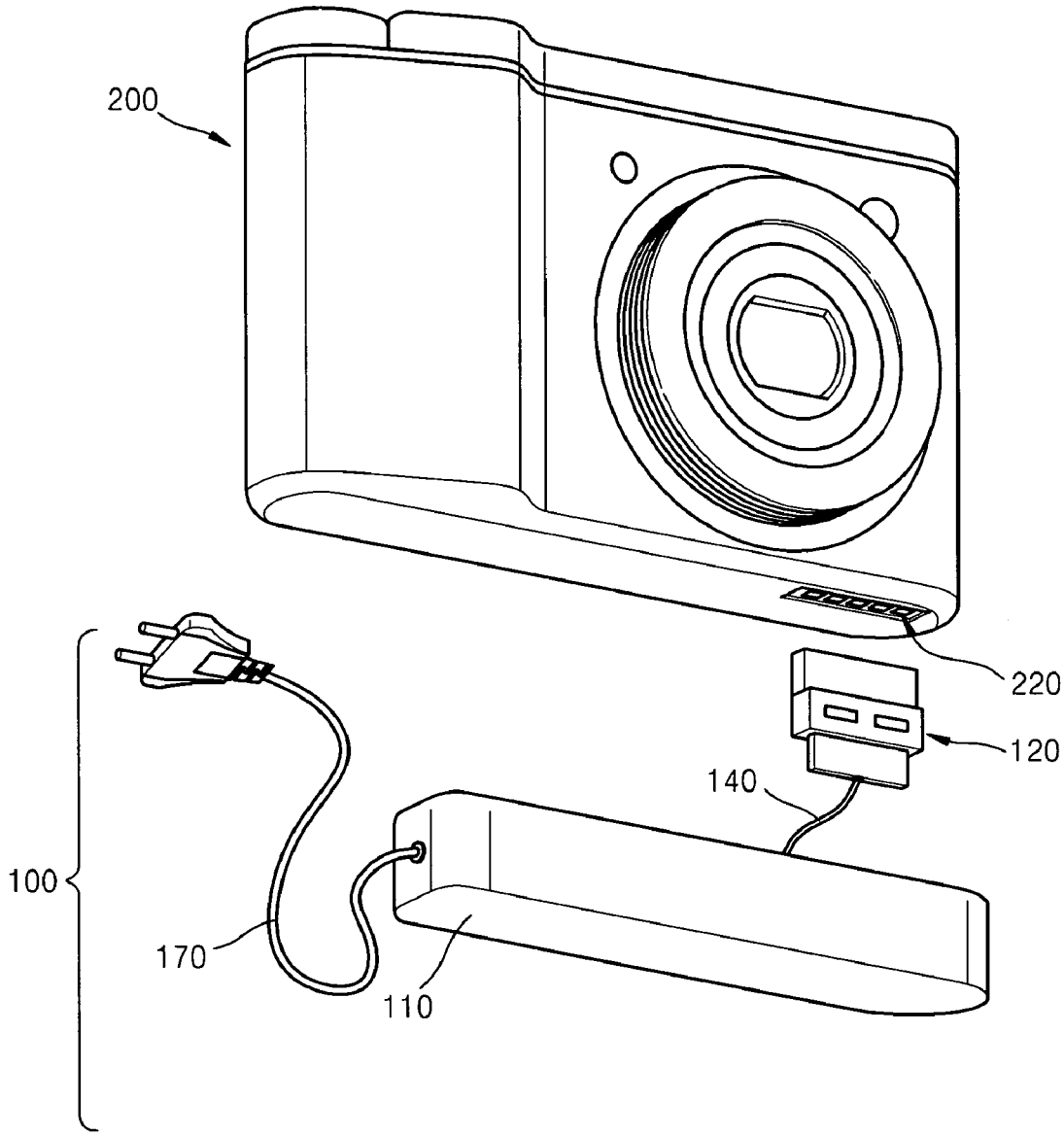
FIG. 7 is a perspective view illustrating a part of an adapter for an electrical device according to another embodiment of the present invention.

FIG. 7 is a perspective view illustrating yet another embodiment of an adapter 100 for an electrical device.

In the previous embodiments, an adapter for an electrical device includes a power input jack 130 (FIGS. 1-6) that is to be coupled to an external power supply device. In contrast, the adapter 100 according to the illustrated embodiment of FIG. 7 includes a cord 170 instead of the power input jack. The cord 170 is electrically connected to a connector 120, and has a plug at one end thereof. If the plug of the cord 170 is inserted into an electrical outlet (not shown), electricity can be directly supplied to an electrical device 200 coupled to the adapter 100. To this end, the present embodiment of adapter 100 may include a power conversion apparatus, module or circuitry such as, for example an AC-DC converter or the like. The adapter 100 according to the current embodiment may also be constructed similar to the adapters for an electrical device according to the above embodiments. For example, the adapter 100 according to the current embodiment may further include an anti-theft unit coupling unit, or be configured for adjustment of the location of the coupling unit 150.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An adapter for an electrical device including a power input terminal, comprising:

a base frame comprising an inner space;

a connector disposed in the base frame, the connector being configured for coupling to the power input terminal of the electrical device, wherein the connector is movably disposed in the inner space, a location of the connector is adjustable according to a location of the power input terminal of the electrical device, and the connector is freely movable in a plurality of dimensions;

a power input jack disposed in the base frame and electrically connected to the connector, the power input jack being configured for interfacing with an external power supply for powering the electrical device; and a coupling unit for connecting the base frame to the electrical device, wherein the base frame includes a guiding unit extending along a lengthwise axis of the base frame, the coupling unit being movably adjustable along the guiding unit.

2. The adapter of claim 1, further comprising an anti-theft unit coupling unit configured for connection with an anti-theft unit for preventing theft of the electronic device.

3. The adapter of claim 1, further comprising a wire extending through the inner space for electrically connecting the power input jack to the connector, the wire being substantially flexible for facilitating movement of the connector relative to the power input jack.

4. The adapter of claim 1, wherein at least one of the power input jack and the connector is unitary or integral with the base frame for securing the base frame to the electrical device.

5. The adapter of claim 1, wherein the electrical device is a photographing device with a tripod-connection hole, and wherein the coupling unit is a fastener that extends through the base frame and threadably mates with the tripod-connection hole.

6. The adapter of claim 5, wherein the fastener includes a head having an aperture or a groove, the aperture or the groove being configured to accept a portion of an anti-theft unit for preventing theft of the electrical device.

7. An adapter for an electrical device including a power input terminal, comprising:

a base frame comprising an inner space;

a connector disposed in the base frame, the connector being configured for coupling to the power input terminal of the electrical device, wherein the connector is movably disposed in the inner space, a location of the connector is adjustable according to a location of the power input terminal of the electrical device, and the connector is freely movable in a plurality of dimensions;

a power input cord connected to the base frame and electrically connected to the connector, the power input cord having a plug at one end of the cord for interfacing with an external power supply for powering the electrical device; and a coupling unit for connecting the base frame to the electrical device, wherein the base frame includes a guiding unit extending along a lengthwise axis of the base frame, the coupling unit being movably adjustable along the guiding unit.

8. The adapter of claim 7, further comprising an anti-theft unit coupling unit configured for connection with an anti-theft unit for preventing theft of the electronic device.

9. The adapter of claim 7, further comprising a wire extending through the inner space for electrically connecting the power input cord to the connector, the wire being substantially flexible for facilitating movement of the connector relative to the power input jack.

10. The adapter of claim 7, further comprising a power conversion apparatus interconnecting the power input cord and the connector, the power conversion apparatus being configured to convert current and voltage from the external power supply to current and voltage suitable for powering the electrical device.

11. The adapter of claim 7, wherein the electrical device is a photographing device with a tripod-connection hole, and wherein the coupling unit is a fastener that extends through the base frame and threadably mates with the tripod-connection hole.

12. The adapter of claim 11, wherein the fastener includes a head having an aperture or a groove, the aperture or the groove being configured to accept a portion of an anti-theft unit for preventing theft of the electrical device.

* * * * *